US007409745B2

(12) United States Patent
Dodson et al.

(10) Patent No.: US 7,409,745 B2
(45) Date of Patent: Aug. 12, 2008

(54) CLEANING PAD FOR VACUUM CLEANER

(75) Inventors: Diane L. Dodson, Sagamore Hills, OH (US); John T. Lackner, Independence, OH (US); John R Lackner, San Jose, CA (US)

(73) Assignee: The Scott Fetzer Company, Westlake, OH (US)

( * ) Notice: Subject to any disclaimer, the term of this patent is extended or adjusted under 35 U.S.C. 154(b) by 570 days.

(21) Appl. No.: 11/200,436

(22) Filed: Aug. 9, 2005

(65) Prior Publication Data

US 2007/0033767 A1 Feb. 15, 2007

(51) Int. Cl.
*A47L 9/02* (2006.01)

(52) U.S. Cl. ..... 15/403; 15/415.1; 15/98

(58) Field of Classification Search ..... 15/403, 15/415.1, 97.1, 98; *A47L 9/02*
See application file for complete search history.

(56) References Cited

U.S. PATENT DOCUMENTS

| | | | | |
|---|---|---|---|---|
| 2,873,465 | A | 2/1959 | Miller | |
| 3,745,605 | A | 7/1973 | Gitschel et al. | |
| 3,820,189 | A | 6/1974 | Roth | |
| 3,833,962 | A | 9/1974 | Krusche | |
| 4,319,379 | A | 3/1982 | Carrigan et al. | |
| 5,399,381 | A | 3/1995 | Randall | |
| 5,537,711 | A | 7/1996 | Tseng | |
| 5,557,823 | A | 9/1996 | Rouda | |
| 5,720,078 | A | 2/1998 | Heintz | |
| 5,909,755 | A | 6/1999 | Leal | |
| 6,260,232 | B1 * | 7/2001 | Nelson et al. | 15/322 |
| 6,966,098 | B2 * | 11/2005 | Sako et al. | 15/364 |
| 7,013,528 | B2 | 3/2006 | Parker et al. | |
| 2004/0250376 | A1 | 12/2004 | Hori et al. | |

FOREIGN PATENT DOCUMENTS

| | | |
|---|---|---|
| CH | 537179 | 4/1972 |
| DE | 4223702 | 7/1991 |
| DE | 19933449 | 7/1999 |
| DE | 10324260 | 12/2004 |
| SU | 1771682 | 6/1990 |

* cited by examiner

*Primary Examiner*—David A. Redding
(74) *Attorney, Agent, or Firm*—Jones Day

(57) ABSTRACT

The claimed invention provides an apparatus for use with a vacuum cleaner nozzle having an intake opening with a flow area that receives a flow of working air. The apparatus comprises a cleaning pad with a structure that permits the working air to pass through the pad. The cleaning pad is configured to be installed over the intake opening in a position extending across the flow area.

3 Claims, 4 Drawing Sheets

CLEANING PAD FOR VACUUM CLEANER

TECHNICAL FIELD

This technology relates to an attachment for a vacuum cleaner.

BACKGROUND

A vacuum cleaner nozzle may have rollers for movement over a hard floor surface to be cleaned by the suction of the vacuum cleaner. The condition of the hard floor surface may sometimes require mopping, scrubbing, dusting or the like, in addition to vacuuming.

SUMMARY

The claimed invention provides an apparatus for use with a vacuum cleaner nozzle having an intake opening with a flow area that receives a flow of working air. The apparatus comprises a cleaning pad with a structure that permits the working air to pass through the pad. The cleaning pad is configured to be installed over the intake opening in a position extending across the flow area.

DESCRIPTION

Figure 1:
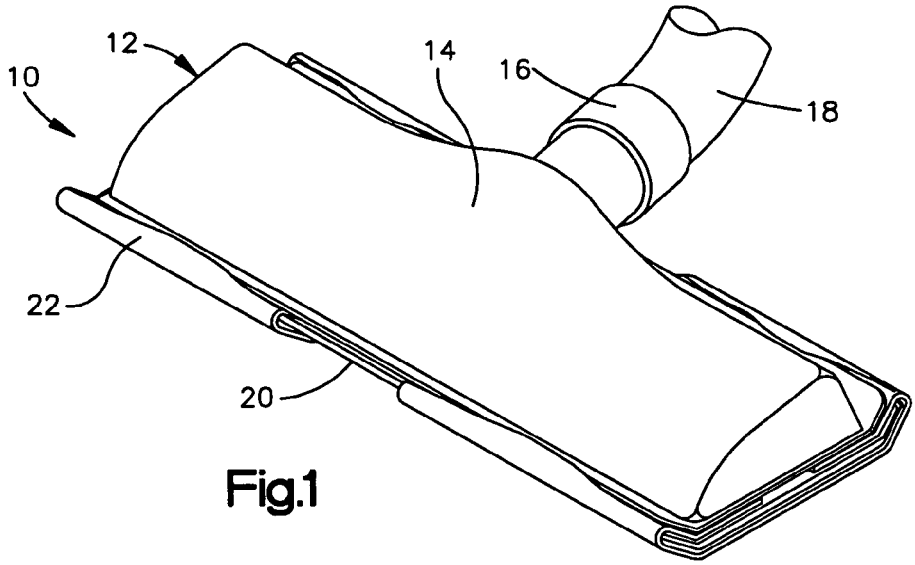
FIG. 1 is a perspective view of a vacuum cleaner nozzle having a cleaning pad installed in accordance with the claimed invention.

The structures shown in the drawings have parts that are examples of the elements recited in the claims. The illustrated structures thus include examples of how a person of ordinary skill in the art can make and use the claimed invention. They are described here to meet the requirements of enablement and best mode without imposing limitations that are not recited in the claims.

The apparatus 10 shown in FIG. 1 includes a vacuum cleaner nozzle 12 with a generally rectangular body 14 and a cylindrical neck 16. A tube 18 extends from the neck 16 to a source of suction for drawing a flow of working air through an intake opening at the bottom of the nozzle body 14. As further shown in FIG. 1, a frame 20 supports a cleaning pad 22 on the bottom of the nozzle body 14. In addition to vacuuming, the apparatus 10 is thus equipped to perform other cleaning functions such as wet or dry mopping, scrubbing, dusting, etc., by contact of the pad 22 with the surface to be cleaned.

Figure 2:
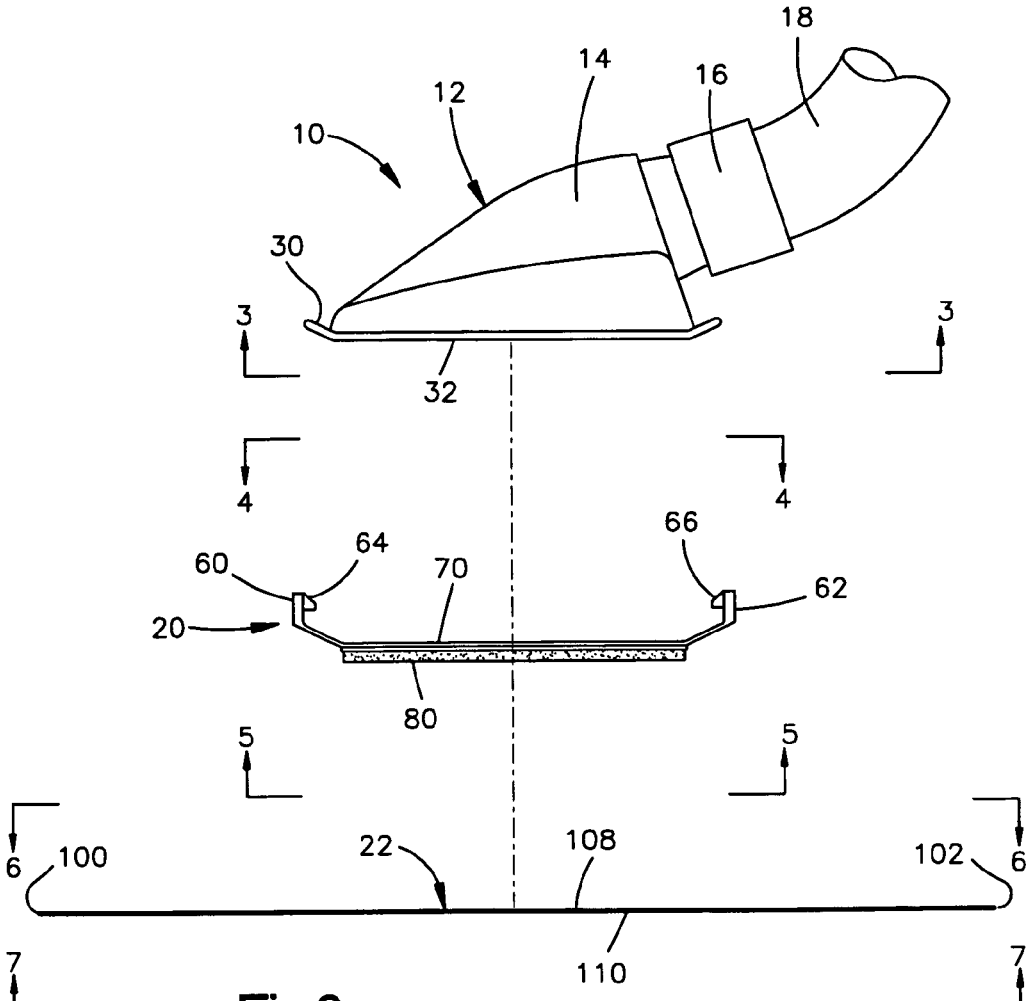
FIG. 2 is an exploded view of parts shown in FIG. 1.

As viewed from the side in FIG. 2, the nozzle body 14 has a peripheral flange 30 that turns upward at the front and rear. As viewed from beneath in FIG. 3, the nozzle body 14 has a planar lower side surface 32. The lower side surface 32 is defined by a base plate 34 that is fitted into the space within the surrounding flange 30. The base plate 34 defines the intake opening 35 which, in the illustrated example, has three distinct sections 37, 38 and 39 extending lengthwise of the base plate 34.

Figure 3:
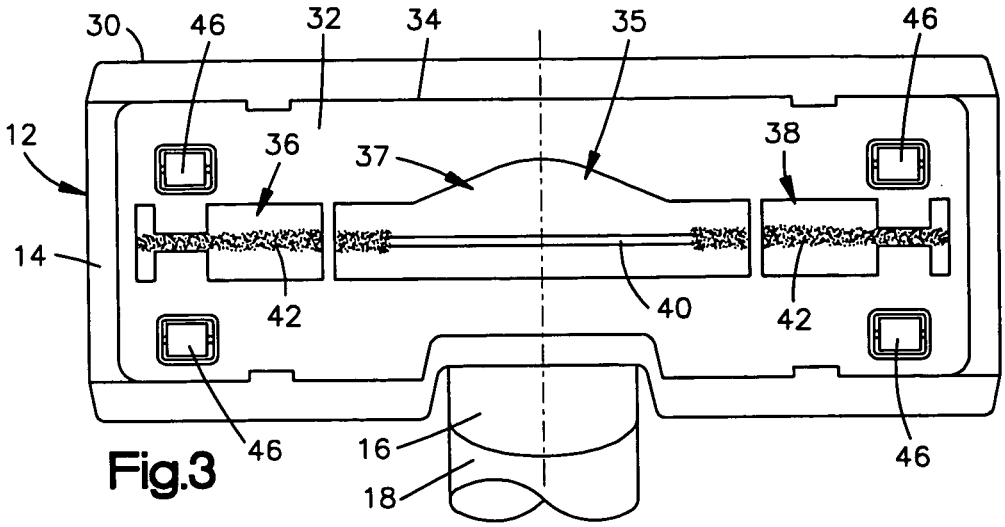
FIG. 3 is a bottom view taken on line 3-3 of FIG. 2.

A brush bar 40 is supported within the nozzle body 14. The brush bar 40 supports bristles 42 that project a short distance outward through the intake opening 35. Also shown in FIG. 3 are rollers 46 which, like the bristles 42, project a short distance downward beneath the lower side surface 32 of the base plate 34. When the frame 20 and the cleaning pad 22 are not installed on the nozzle 12, the rollers 46 can support the nozzle 12 for movement on a hard floor surface. The surface can then be cleaned by the brushing action of the bristles 42 and the stream of working air that is drawn inward through the combined flow area of the three sections 36, 37 and 38 of the intake opening 35.

Referring again to the side view of FIG. 2, the frame 20 has mounting flanges 60 and 62 projecting upward for engagement with the flange 30 on the nozzle 12. As viewed from above in FIG. 4, the frame 20 has a generally rectangular configuration closely matching the combined configuration of the base plate 34 and the flange 30 at the bottom of the nozzle 12. The mounting flange 60 at the front of the frame 20 extends fully along its length, and has a pair of locking tabs 64 configured to snap into releasably interlocked engagement with the flange 30 at the front of the nozzle 12. The mounting flange 62 at the rear of the frame 20 has two sections corresponding to two sections of the flange 30 at the rear of the nozzle 12, and has two locking tabs 66 configured to snap into interlocked engagement with the flange 30 at those locations.

A planar upper side surface 70 of the frame 20 corresponds to the planar lower side surface 32 of the base plate 34 (FIG. 3), and an intake opening 75 in the frame 20 corresponds with the intake opening 35 in the base plate 34. Apertures 76 near the four comers of the upper side surface 70 correspond with the rectangular array of rollers 46 at the base plate 34. An indicator arrow 78 on the upper side surface 70 points toward the front of the frame 20.

Figure 5:
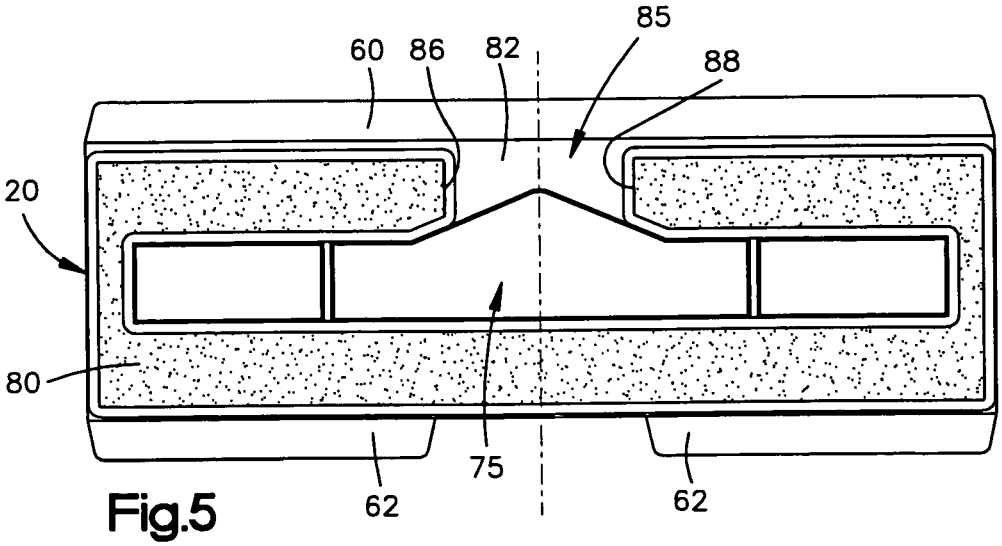
FIG. 5 is a bottom view taken on line 5-5 of FIG. 2.

A sponge 80 (FIG. 5) is mounted on a planar lower side surface 82 of the frame 20. The sponge 80 has an elongated configuration extending about the periphery of the intake opening 75. A gap 85 extends between the opposite ends 86 and 88 of the sponge 80 to define a channel for a stream of debris-laden working air to reach the intake opening 75 by flowing under the frame 20 in a direction extending rearwardly across and beneath the lower side surface 82.

The cleaning pad 22 has a structure that permits the flow of working air to pass through the pad 22. Such permeability can be accomplished by forming the pad 22 of air-permeable material and/or by perforating a pad formed of material that is not air-permeable. In the illustrated example, the cleaning pad 22 is formed of air-permeable material, and also is perforated for additional permeability as well as for the passage of debris.

More specifically, the illustrated example of a cleaning pad 22 is a single, one-layer sheet of soft fabric with front and rear edges 100 and 102, left and right edges 104 and 106, and upper and lower side surfaces 108 and 110. A slot 112 extending through the pad 22 is large enough for the passage of relatively large debris. The slot 112 is centered on the transverse centerline 115 of the pad 22 and is closer to the forward edge 100 than to the rear edge 102. A plurality of slits 116 also extend through the pad 22. The slits 116 are arranged lengthwise of the pad 22 in an array that is evenly distributed throughout the length and width of the pad 22. The slits 116 permit the passage of working air through the pad 22, and also permit the passage of debris that is relatively small, yet larger than that which is passable by the air-permeable material of which the pad 22 is formed.

Figure 4:
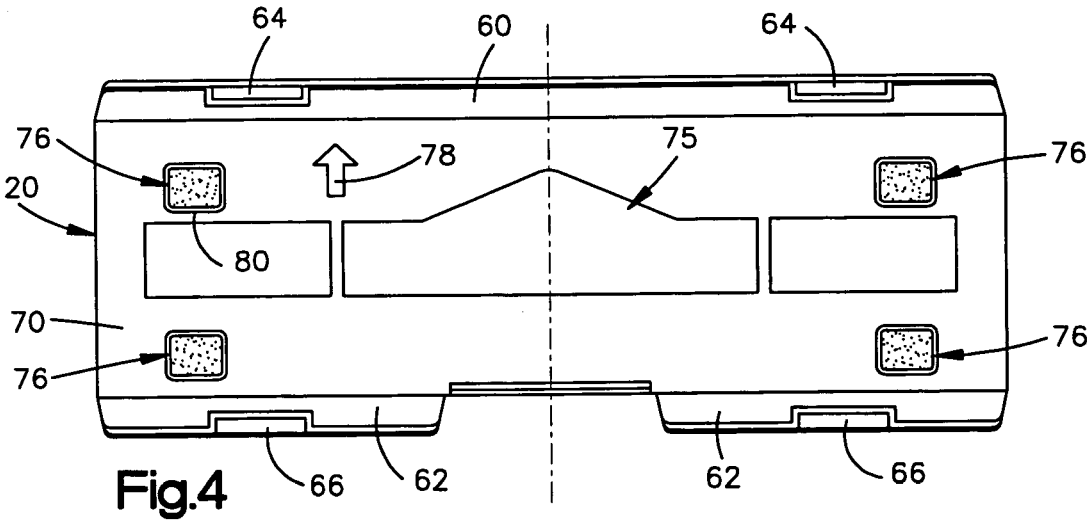
FIG. 4 is a top view taken on line 4-4 of FIG. 2.
Figure 6:
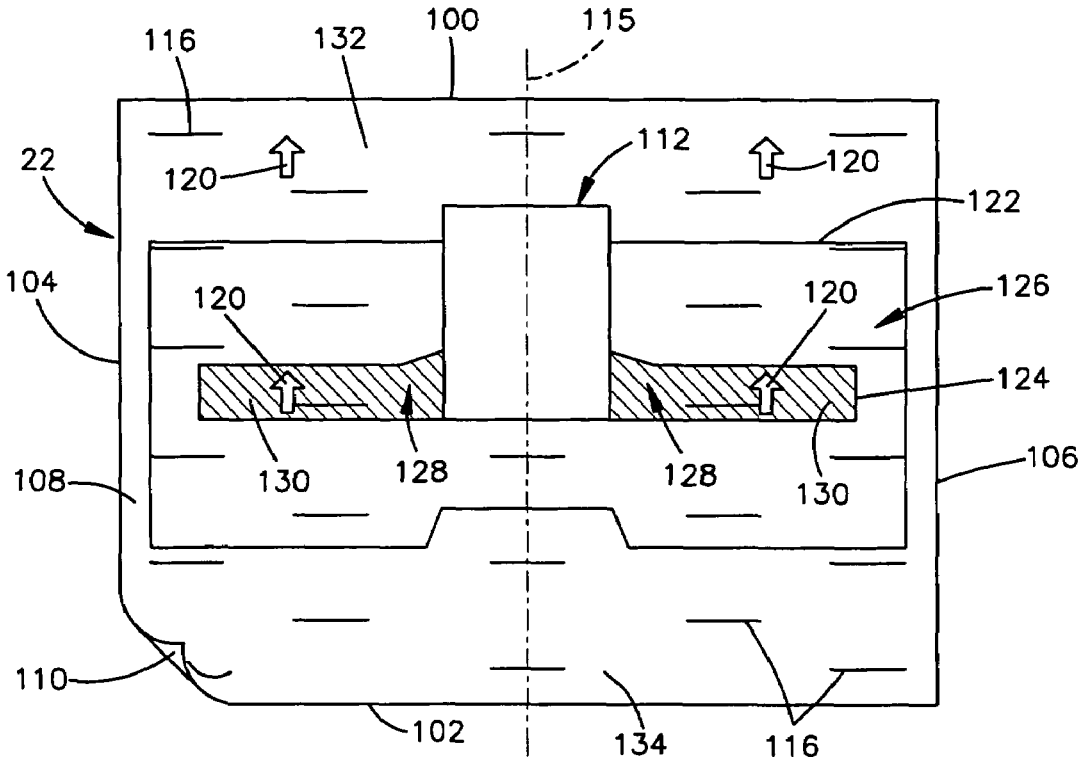
FIG. 6 is a top view taken on line 6-6 of FIG. 2.
Figure 7:
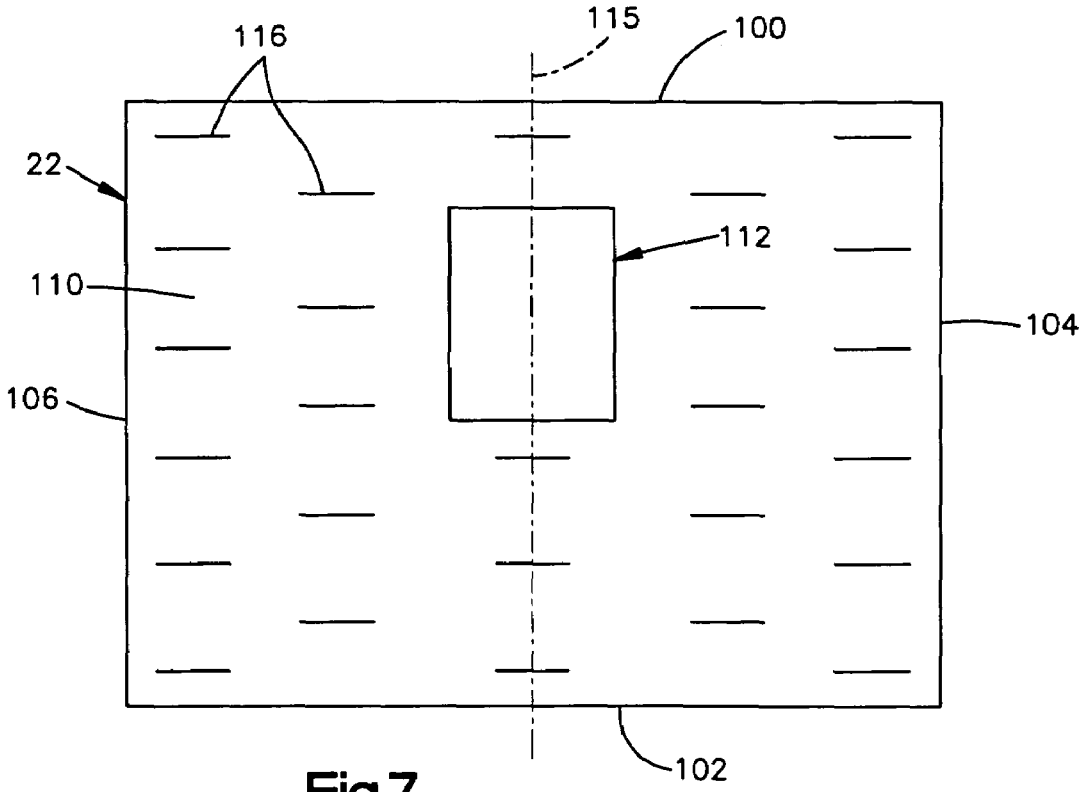
FIG. 7 is a bottom view taken on line 7-7 of FIG. 2.

As further shown in FIGS. 6 and 7, the upper side surface 108 of the pad 22 bears installation indicia, but is otherwise the same as the lower side surface 110. The installation indicia includes arrows 120, a primary boundary line 122, and two secondary boundary lines 124. The arrows 120 point toward the front edge 100. The primary boundary line 122 encloses a placement zone 126 with a size and shape closely matching that of the frame 20 (FIG. 4). The secondary boundary lines 124 enclose smaller placement zones 128 on opposite sides of the slot 112. Each of those placement zones 128 has a size and shape corresponding to a respective end portion of the intake opening 75 in the frame 20 (FIG. 3). Additional indicator lines 130 provide shading for greater visual contrast between the placement zones 126 and 128. A front edge portion 132 of the pad 22 is located forward of the primary placement zone 126. A rear edge portion 134 is located rearward of the secondary placement zones 128.

Figure 8:
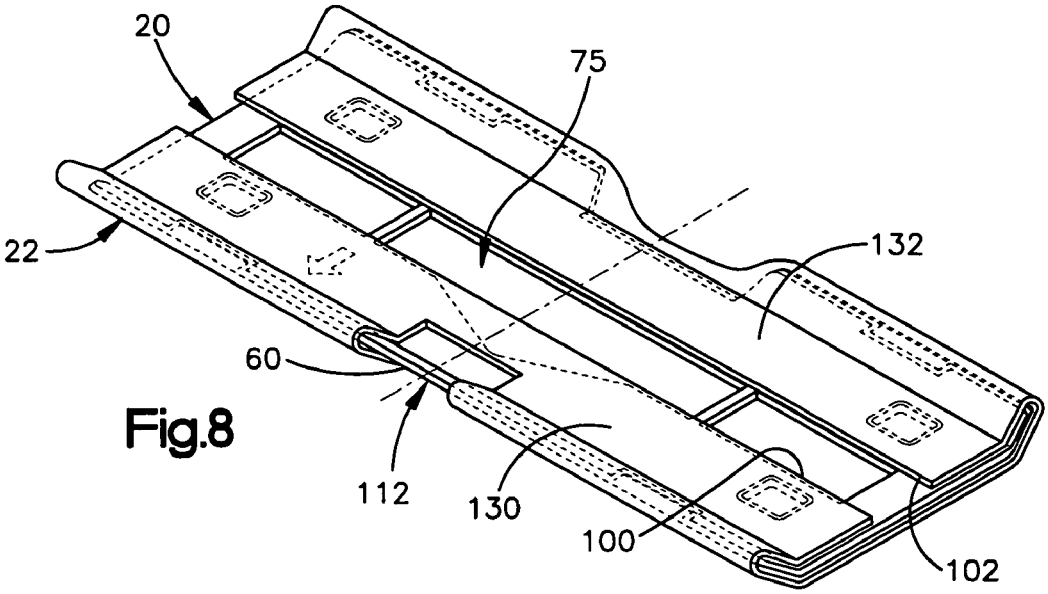
FIG. 8 is a perspective view of parts shown in FIG. 1.
Figure 9:
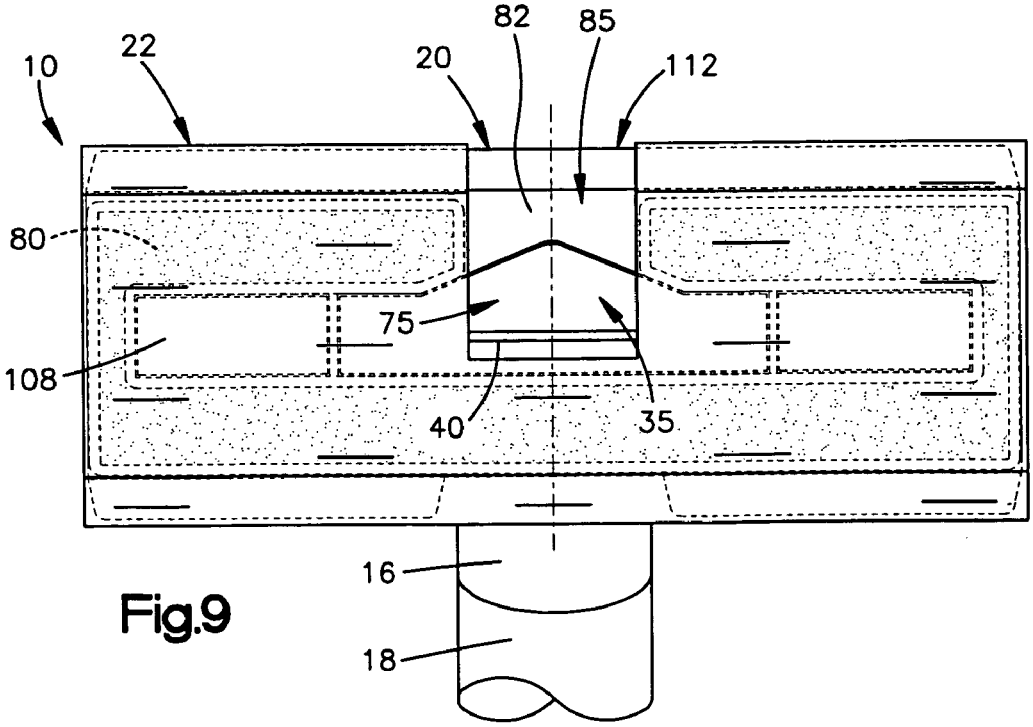
FIG. 9 is a bottom view of parts shown in FIG. 1.

The cleaning pad 22 is installed on the nozzle 12 by first placing the pad 22 on a hard floor surface in the flat condition shown in FIG. 6. The frame 20 is placed downward upon the upper side surface 108 of the pad 22, with the indicator arrow 78 pointing toward the front edge 100 of the pad 22, and with the frame 20 arranged in overlying alignment with the placement zones 126 and 128 on the pad 22. Next, the front edge portion 132 of the pad 22 is folded upward and backward over the mounting flange 60 at the front of the frame 20, and is placed downward in a folded position overlying the upper side surface 70 of the frame 20 at a location forward of the intake opening 75. In a similar manner, the rear edge portion 132 of the pad 22 is folded upward and forward over the mounting flange 62 at the rear of the frame 20, and is placed downward onto the upper side surface 70 behind the intake opening 75. Having wrapped the pad 22 around the frame 20 as shown in FIG. 8, the user can place the nozzle 12 forcefully downward upon those parts to snap the flange 30 on the nozzle body 14 into engagement with the locking tabs 64 and 66 on the frame 20. The edge portions 130 and 132 of the pad 22 are then clamped between the flange 30 and the locking tabs 64, 66, as shown in FIG. 1. In this arrangement, the pad 22 extends across the flow area defined by the aligned intake openings 75 and 35 in the nozzle 12 and the frame 20, with the slot 112 in the pad 22 projecting forward in alignment with the channel 85 between the opposite ends of the sponge 80 on the frame 20, as shown in the bottom view of FIG. 9.

This written description sets forth the best mode of carrying out the invention, and describes the invention so as to enable a person skilled in the art to make and use the invention, by presenting examples of the elements recited in the claims. The patentable scope of the invention is defined by the claims, and may include other examples that occur to those skilled in the art. Such other examples, which may be available either before or after the application filing date, are intended to be within the scope of the claims if they have elements that do not differ from the literal language of the claims, or if they have insubstantial differences from the literal language of the claims.

The invention claimed is:

1. An apparatus for use with a vacuum cleaner nozzle having an intake opening that receives a flow of debris-laden working air, the apparatus comprising:

a frame that has an intake opening and is receivable on the vacuum cleaner in an installed position in which the intake opening in the frame is aligned with the intake opening in the vacuum cleaner nozzle;

a sponge that is mounted on the frame and has an elongated shape extending around the intake opening in the frame, with opposite ends of the sponge spaced apart from each other to define an air flow channel extending from an edge of the frame to the intake opening in the frame; and a cleaning pad having a structure that permits debris-laden working air to pass through the cleaning pad, and having an opening for the passage of debris larger than that which is passable by the structure of the cleaning pad;

the cleaning pad being receivable on the frame in an installed position overlying the sponge and extending over the intake opening in the frame, with the opening in the cleaning pad aligned with the channel in the sponge, whereby relatively small debris can be drawn into the intake opening through the cleaning pad and relatively large debris can be drawn into the intake opening through the aligned opening and channel.

2. An apparatus as defined in claim 1 wherein the cleaning pad is formed of air-permeable material.

3. An apparatus as defined in claim 1 wherein the cleaning pad is perforated to allow the passage of debris-laden working air.

* * * * *